United States Patent [19]

Gruber et al.

[11] 4,452,299

[45] Jun. 5, 1984

[54] PROCESS FOR CASTING METALS

[75] Inventors: Bruce A. Gruber, Worthington; Heimo J. Langer; William R. Dunnavant, both of Columbus, all of Ohio

[73] Assignee: Ashland Oil, Inc., Ashland, Ky.

[21] Appl. No.: 486,164

[22] Filed: Apr. 15, 1983

Related U.S. Application Data

[62] Division of Ser. No. 320,026, Nov. 10, 1981, Pat. No. 4,394,466, which is a division of Ser. No. 174,970, Aug. 4, 1980, Pat. No. 4,320,218.

[51] Int. Cl.[3] ..... B22C 1/20

[52] U.S. Cl. ..... 164/521; 164/525

[58] Field of Search ..... 164/525, 526, 138, 521

[56] References Cited

U.S. PATENT DOCUMENTS 4,268,425 5/1981 Gardikes ..... 164/521

*Primary Examiner*—Kuang Y. Lin

*Attorney, Agent, or Firm*—Pollock, Vande Sande & Priddy

[57] ABSTRACT

A process for casting metal which includes pouring the metal into or around a molded article obtained from a molding composition wherein the binder includes certain fulvenes and/or prepolymers thereof, and a metal salt catalyst. The metal is cooled, solidified, and separated from the molded article.

22 Claims, No Drawings

PROCESS FOR CASTING METALS

This is a division of application Ser. No. 320,026 filed, Nov. 10, 1981, now U.S. Pat. No. 4,394,466, which in turn is a divisional of application Ser. No. 174,970, filed Aug. 4, 1980 and now U.S. Pat. No. 4,320,218.

DESCRIPTION

1. Technical Field

The present invention is directed to compositions which are curable in air at normal room temperatures, and is especially concerned with compositions containing certain fulvenes and/or prepolymers thereof. The compositions of the present invention are particularly useful as foundry binders.

2. Background Art

Fulvenes as well as their method of preparation have been known for some time. Also, it has been known that fulvenes polymerize in the presence of acids.

Although fulvenes have been known for some time and are relatively inexpensive, such have not been used commercially to any great extent. Recently it was discovered that fulvenes and/or fulvene prepolymers could be employed as binders for foundry applications as described in U.S. patent application Ser. No. 42,464, filed May 25, 1979, now U.S. Pat. No. 4,246,167, and entitled "Foundry Binder Composition" to Grimm et al and assigned to Ashland Oil, Inc., the assignee of the present application.

Providing alternative ways in which to cure the fulvenes, especially at normal room temperatures, can be quite difficult. This is especially true when it is desired to use the fulvenes in binder compositions for molding shapes and especially in the foundry art as a binder for cores and molds.

For instance, in the foundry art, cores and molds used in making metal castings are generally prepared from shaped, cured mixtures of aggregate material (e.g. sand) and a binder. One of the preferred techniques of making cores includes the basic steps of mixing the aggregate with a resin binder and a curing catalyst, molding the mixture to the desired shape and allowing it to cure and solidify at room temperature without the application of heat. Such technique is commonly referred to as a "no bake" process.

Compositions which are suitable for use in such a process must possess a number of important characteristics. For instance, the composition must be capable of curing to a considerable degree at normal room temperatures. Since curing of the compositions occurs while as a thin layer or film on the aggregate and the aggregate can act as a heat sink, the curing does not necessarily proceed in the same manner as when the binder is cured in bulk. Moreover, the foundry cores and molds must retain the strength characteristics until the metal solidifies in the mold, but must lose such properties when exposed to elevated temperatures experienced during casting of the metal so that after solidification of the metal the cores or molds can be readily broken down for shakeout or removal from the casting.

DISCLOSURE OF INVENTION

The present invention is directed to an air curable composition which includes a fulvene and/or prepolymer thereof; and a metal catalyst. The fulvenes employed are represented by the formula:

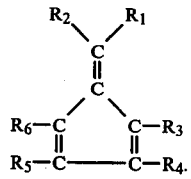

Each $R_1$ and $R_2$ individually is hydrogen or a hydrocarbon containing 1–10 carbon atoms, or a hydrocarbon containing one or more oxygen bridges in the chain thereof, or a furyl group, or are interconnected and, together with the carbon atom to which they are connected, form a cyclic group. Each $R_3$, $R_4$, $R_5$ and $R_6$ individually is hydrogen or methyl, provided that a maximum of only one such $R_3$, $R_4$, $R_5$ and $R_6$ is methyl. In addition, if excess aldehyde or ketone is employed in the preparation of the fulvene, $R_4$ or $R_5$ can have the structure:

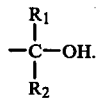

In such a case, $R_3$ and $R_6$ will be as previously discussed.

The composition also includes a metal salt catalyst in a catalytic amount. The metal constituent is a metal having at least two valence states, and accordingly is capable of oxidation and reduction.

The present invention is also concerned with molding compositions which include a major amount of aggregate and an effective bonding amount up to about 40% by weight of the aggregate of the above-defined curable composition.

The present invention is also directed to a process for the fabrication of molded articles which includes the following steps:

(a) mixing aggregate with a bonding amount up to about 40% by weight based upon the weight of the aggregate of a binder composition of the type described hereinabove;

(b) introducing the composition obtained from step (a) into a mold;

(c) hardening the composition in the mold to become self-supporting; and (d) thereafter removing the shaped article of step (c) from the mold and allowing it to further cure, thereby obtaining a hardened, solid, cured, molded article.

The present invention is also concerned with a process for casting a metal which includes fabricating a shape as described hereinabove, pouring metal while in the liquid state into or around the shape, allowing the metal to cool and solidify, and then separating the molded metal article.

BEST AND VARIOUS MODES FOR CARRYING OUT INVENTION

The fulvenes employed according to the present invention are represented by the formula:

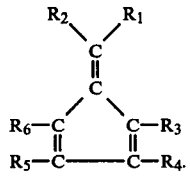

Each $R_1$ and $R_2$ individually is hydrogen or hydrocarbon containing 1 to 10 carbon atoms, or a hydrocarbon containing 1 or more oxygen bridges in the chain and containing up to 10 carbon atoms; or a furyl group; or are interconnected and together with the carbon atoms to which they are interconnected form a cyclic group. The hydrocarbon groups can be free from nonbenzenoid unsaturation or can include ethylenic unsaturation. Examples of some hydrocarbon groups include alkyl groups, such as methyl, ethyl, propyl, and butyl; aryl groups, such as phenyl and napthyl; alkaryl groups, such as benzyl; aralkyl groups; and ethylenically unsaturated groups, such as vinyl. An example of a hydrocarbon containing at least one oxygen bridge in the chain is methoxypentylidene. Examples of some cyclic groups include cycloaliphatic groups, such as cyclopentyl, cyclohexyl, and cycloheptyl.

$R_3$, $R_4$, $R_5$ and $R_6$ each individually is hydrogen or methyl, provided that a maximum of only one $R_3$, $R_4$, $R_5$ or $R_6$ is methyl. Mixtures of the fulvenes can be used when desired.

In addition, prepolymers of the above fulvenes can be used in place of or in combination with the fulvenes provided they still contain sufficient unsaturation (e.g. at least about 10%) for subsequent curing to provide the needed strength characteristics and properties for molded articles, and especially for foundry shapes, and are still fluid enough so that when applied either per se or in admixture with the diluents will flow to coat the aggregate. Mixtures of fulvene prepolymers can be used.

In addition, if excess aldehyde or ketone is employed in the preparation of the fulvene, $R_4$ or $R_5$ can have the structure:

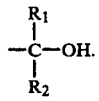

In such a case, $R_3$ and $R_6$ will be as previously described.

Examples of some fulvenes are dimethylfulvene ($R_1$ and $R_2$ are methyl; and $R_3$, $R_4$, $R_5$ and $R_6$ are H); methylisobutylfulvene ($R_1$ is methyl; $R_2$ is isobutyl; $R_3$, $R_4$, $R_5$ and $R_6$ are H); methylphenylfulvene ($R_1$ is phenyl; $R_2$ is methyl; $R_3$, $R_4$, $R_5$ and $R_6$ are H); cyclohexylfulvene ($R_1$ and $R_2$ are interconnected and form a cyclohexyl ring with the common carbon atom to which they are connected $R_3$, $R_4$, $R_5$ and $R_6$ are H); methylethylfulvene ($R_1$ is methyl; $R_2$ is ethyl; $R_3$, $R_4$, $R_5$ and $R_6$ are H); diphenylfulvene ($R_1$ and $R_2$ are phenyl; $R_3$, $R_4$, $R_5$ and $R_6$ are H); furylfulvene ($R_1$ is furyl; $R_2$ is H; and $R_3$, $R_4$, $R_5$ and $R_6$ are H); diisobutylfulvene ($R_1$ and $R_2$ are isobutyl; $R_3$, $R_4$, $R_5$ and $R_6$ are H); isophoronefulvene ($R_1$ and $R_2$ are interconnected and form an isophorone ring with the common carbon atom to which they are connected; $R_3$, $R_4$, $R_5$ and $R_6$ are H); methylvinylfulvene ($R_1$ is methyl; $R_2$ is vinyl; $R_3$, $R_4$, $R_5$ and $R_6$ are H); and methyl $\beta$-methoxyisobutylfulvene ($R_1=CH_3$; $R_2=-CH_2-C[CH_3]_2-O-CH_3$; $R_3$, $R_4$, $R_5$ and $R_6$ are H).

Fulvenes have been known for many years as well as their method of preparation. Also, it has been known that fulvenes polymerize in the presence of acids. The fulvenes employed according to the present invention can be prepared by reacting a carbonyl compound (e.g., ketones and aldehydes) with cyclopentadiene and/or methylcyclopentadiene in the presence of a basic catalyst, such as a strong base (e.g. KOH), an amine, and basic ion exchange resins. Suggestions of methods for preparing fulvenes can be found in U.S. Pat. Nos. 2,589,969; 3,051,765; and 3,192,275. In addition, fulvenes can be purified by distillation according to a method by Kice, J.A.C.S. 80, 3792 (1958), and the method of McCaine, J. Chem. Society 23, 632 (1958).

In addition, the compositions of the present invention contain a catalytic amount of metal salt of a carboxylic acid. The metal moiety of the salt is a metal having at least two valence states and capable of oxidation-reduction. Examples of some metal moieties suitable for the present invention include Group IB metals, such as copper and gold; Group IVA metals, such as tin and lead; Group IVB metals, such as zirconium; Group III metals, such as cerium; Group VB metals, such as vanadium; Group VIIB metals, such as manganese; and Group VIII metals, such as cobalt and iron. The preferred metals include cobalt and lead with the most preferred being cobalt. The identity of the organic moiety of the metal salt is not particularly critical since one type of salt of a particular metal generally shows no advantage over another type of salt of the same metal. Some common commercial organic moieties include the neodecanates, naphthenates, octoates, tallates, and linoleates. The catalyst is preferably soluble in the fulvene, and most preferably is also oil soluble.

The metallic catalyst is employed in amounts usually between about 0.2 to about 1.2% by weight of metal based on the weight of the fulvene and/or fulvene prepolymer. The curing is affected in the presence of air.

One particular advantage of the present invention is that the compositions can also include an ethylenically unsaturated polymerizable compound and thereby achieve increased strength characteristics. When an ethylenically unsaturated compound is employed, it is necessary to include, in addition to the metallic curing agent, a peroxide or hydroperoxide to effect the polymerization of the ethylenically unsaturated compound. Preferred metal compounds employed with the peroxides or hydroperoxides include cobalt and vanadium, and most preferably cobalt. Such metals act to decompose the peroxides and hydroperoxides.

The ethylenically unsaturated compounds can be monoethylenically unsaturated or can include more than one ethylenically unsaturated group. Examples of some suitable ethylenically unsaturated compounds include acrylic acid, methacrylic acid; esters of acrylic acid or methacrylic acid with monohydric alcohols, such as methyl, ethyl, butyl, octyl, dodecyl, cyclohexyl, allyl, methallyl, undecenyl, cyanoethyl, dimethylaminoethyl, and the like; esters of itaconic acid and similar alcohols; esters from maleic, fumaric, or citraconic acids with similar alcohols; vinyl esters of carboxylic acids, such as acetic, propionic, butyric, and the like; vinyloxyalkyl esters, such as vinyloxyethylacetate; vinylethers such as ethylvinylether, butylvinylether, octylvinylether, allylvinylether, hydroxyethylvinylether, aminoethylvinylether, vinyloxyethoxyethanol, and vinyloxypropoxyethanol; methacrylonitrile; acrylamide, methacrylamide and N-substituted amides of this type; vinylchloride; vinylidenechloride; 1-chloro-1-fluoroethylene; ethylene; 1-acetoxy-1, 3-butadiene; styrene; divinylbenzene and butadiene.

The preferred ethylenically unsaturated compounds are polyethylenically unsaturated compounds, and most preferably those which contain terminal ethylenic groups. Such compounds include unsaturated esters of polyols, and especially esters of ethylene carboxylic acids, such as ethyleneglycol diacrylate, diethyleneglycol diacrylate, propyleneglycol diacrylate, glycerol diacrylate, glycerol triacrylate; ethyleneglycol dimethacrylate, 1,3-propyleneglycol dimethacrylate, 1,2,4-butanetriol trimethacrylate, pentaerythritol trimethacrylate, 1,3-propanediol diacrylate, 1,6-hexanediol diacrylate, the acrylates and methacrylates of polyethylene glycols of molecular weight 200 to 500, trimethylolpropane triacrylate, pentaerythritol triacrylate, unsaturated amides, such as those of the ethylene carboxylic acids, and especially those of alpha, omega-diamines and oxygen-interrupted omega-diamines, such as methylene bisacryl, and bismethacrylamide; vinyl esters, such as divinylsuccinate, divinyladipate, divinylphthalate and divinylterephthalate.

The preferred polyethylenically unsaturated compounds include the polyethylene glycol diacrylates and trimethylolpropane triacrylate.

In addition, prepolymers and copolymers of the above ethylenically unsaturated monomers can be employed provided such still include ethylenic unsaturation so that additional polymerization can occur in the curing of the compositions.

When employed, the ethylenically unsaturated compounds are present in amounts up to about 50% by weight based upon the weight of the fulvene and ethylenically unsaturated compound. Preferably, the ethylenically unsaturated compound is present in amounts from about 20 to about 40% by weight based upon the weight of the fulvene and ethylenically unsaturated compound.

Examples of peroxides and hydroperoxides include di-tertbutylperoxide, benzoylperoxide, ascaridol, t-butylperbenzoate, t-butylhydroperoxide, methylethylketone peroxide, hydrogen peroxide, lauroyl peroxide, tertbutylperbenzoate, 1,1'-hydroperoxydiglycol, hexylperoxide, and the like. The preferred peroxide is methylethylketone peroxide. The peroxide and/or hydroperoxide is present in the composition in an amount of about 1 to about 15%, and preferably in an amount of about 3 to about 8% by weight, based upon the weight of the fulvene and ethylenically unsaturated material.

When preparing an ordinary sand-type foundry shape, the aggregate employed has a particle size large enough to permit sufficient porosity in the foundry shape to permit escape of volatiles from the shape during the casting operation. The term "ordinary sand-type foundry shapes" as used herein refers to foundry shapes which have sufficient porosity to permit excape of volatiles from it during the casting operation. Generally, at least about 80%, and preferably about 90%, by weight of aggregate employed for foundry shapes has an average particle size no smaller than about 150 mesh (Tyler screen mesh). The aggregate for foundry shapes preferably has an average particle size between about 50 and about 150 mesh (Tyler screen mesh). The preferred aggregate employed for ordinary foundry shapes is silica sand wherein at least about 70 weight percent, and preferably at least about 85 weight percent of the sand is silica. Other suitable aggregate materials include zircon, olivine, alumino-silicate sand, chromite sand and the like.

When preparing a shape for precision casting, the predominant portion, and generally at least about 80% of the aggregate, has an average particle size no larger than about 150 mesh (Tyler screen mesh), and preferably between 325 mesh and 200 mesh (Tyler screen mesh). Preferably at least about 90% by weight of the aggregate for precision casting applications has a particle size no larger than 150 mesh and preferably between 325 mesh and 200 mesh. The preferred aggregates employed for precision casting applications are fused quartz, zircon sands, magnesium silicate sands such as olivine, and alumino-silicate sands.

Shapes for precision casting differ from ordinary sand-type foundry shapes in that the aggregate in shapes for precision casting can be more densely packed than the aggregate in shapes for ordinary sand-type foundry shapes. Therefore, shapes for precision casting must be heated before being utilized to drive off volatizable material present in the molding composition. If the volatiles are not removed from a precision casting shape before use, vapor created during casting will diffuse into the molten melt, since the shape has a relatively low porosity. The vapor diffusion would decrease the smoothness of the surface of the precision cast article.

When preparing a refractory, such as a ceramic, the predominant portion and at least about 80% by weight of the aggregate employed has an average particle size under 200 mesh and preferably no larger than 325 mesh. Preferably at least about 90% by weight of the aggregate for a refractory has an average particle size under 200 mesh, and preferably no larger than 325 mesh. The aggregate employed in the preparation of refractories must be capable of withstanding the curing temperatures, such as above about 1500° F. which are needed to cause sintering for utilization.

Examples of some suitable aggregate employed for preparing refractories include the ceramics, such as refractory oxides, carbides, nitrides, and silicides, such as aluminum oxide, lead oxide, chromic oxide, zirconium oxide, silica, silicon carbide, titanium nitride, boron nitride, molybdenum disilicide, and carbonaceous material, such as graphite. Mixtures of the aggregates can also be used, when desired, including mixtures of metals and the ceramics.

Examples of some abrasive grains for preparing abrasive articles include aluminum oxide, silicon carbide, boron carbide, corundum, garnet, emery and mixtures thereof. The grit size is of the usual grades as graded by the United States Bureau of Standards. These abrasive materials and their uses for particular jobs are understood by persons skilled in the art and are not altered in the abrasive articles contemplated by the present invention. In addition, inorganic filler can be employed along with the abrasive grit in preparing abrasive articles. It is preferred that at least about 85% of the inorganic fillers has an average particle size no greater than 200 mesh. It is most preferred that at least about 95% of the inorganic filler has an average particle size no greater than 200 mesh. Some inorganic fillers include cryolite, fluorospar, silica and the like. When an organic filler is employed along with the abrasive grit, it is generally present in amounts from about 1 to about 30% by weight based upon the combined weight of the abrasive grit and inorganic filler.

In molding compositions, the aggregate constitutes the major constituent and the binder constitutes a relatively minor amount. In ordinary sand type foundry applications, the amount of binder is generally no greater than about 10% by weight and frequently within the range of about 0.5 to about 7% by weight based upon the weight of the aggregate. Most often, the binder content ranges from about 0.6 to about 5% by weight based upon the weight of the aggregate in ordinary sand type foundry shapes.

In molds and cores for precision casting application the amount of binder is generally no greater than about 40% by weight and frequently within the range of about 5 to about 20% by weight based upon the weight of the aggregate.

In refractories, the amount of binder is generally no greater than about 40% by weight and frequently within the range of about 5% to about 20% by weight based upon the weight of the aggregate.

In abrasive articles, the amount of binder is generally no greater than about 25% by weight and frequently within the range of about 5% to about 15% by weight based upon the weight of the abrasive material or grit.

The molding mix is molded into the desired shape, whereupon it can be cured. Curing is effected in the presence of oxygen by the action of a metal salt catalyst previously incorporated into the mix. The curing can be carried out at normal room temperature. The present invention is therefore suitable for "no-bake" foundry applications.

A valuable additive to the binder compositions of the present invention in certain types of sand is a silane having the general formula:

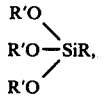

wherein R′ is a hydrocarbon radical and preferably an alkyl radical of 1 to 6 carbon atoms and R is a hydrocarbon group such as a vinyl group or an alkyl radical; an alkoxy-substituted alkyl radical; or an alkyl-amine-substituted alkyl radical in which the alkyl groups have from 1 to 6 carbon atoms. The aforesaid silane when employed in concentrations of about 0.05 to 2% based on the binder component of the composition improves the humidity resistance of the system.

Examples of some commercially available silanes are Dow Corning Z6040 and Union Carbide A-187 (gamma glycidoxy propyltrimethoxy silane); Union Carbide A-1100 (gamma aminopropyltriethoxy silane); Union Carbide A-1120 (N-beta (amino-ethyl)-gamma aminopropyltrimethoxy silane); Union Carbide A-1160 (Ureido-silane); Union Carbide A-172 [vinyl-tris(beta methoxyethoxy)silane]; and vinyltriethoxysilane.

When the compositions of the present invention are used to prepare ordinary sand-type foundry shapes, the following steps are employed:

1. forming a foundry mix containing an aggregate (e.g. sand) and the contents of the binder system;
2. introducing the foundry mix into a mold to thereby obtain a green foundry shape;
3. allowing the green foundry shape to remain in the mold in the presence of oxygen for a time at least sufficient for the shape to obtain a minimum stripping strength, i.e. become self-supporting; and
4. thereafter removing the shape from the mold allowing it to cure at room temperature, thereby obtaining a hard solid cured foundry shape.

In addition, if desired, the cured shape can be post cured at elevated temperatures, such as about 50° to 200° C., and preferably about 100° to 150° C., for about ¼ to 1 hour. Post curing increases strength characteristics.

In order to further understand the present invention, the following non-limiting examples concerned with foundry are provided. All parts are by weight unless the contrary is stated. The foundry samples are cured by the so-called "no-bake" process.

EXAMPLE 1

Preparation of Methyl Isobutyl Fulvene

Into a glass reactor equipped with a dropping funnel and nitrogen inlet is charged methanol (240 ml) containing potassium hydroxide (1.2 moles). The solution is cooled to 10°-15° C. and freshly distilled cyclopentadiene (2 moles) is added. From the dropping funnel 4-methyl pentane-2-one is added at a rate to keep the reaction temperature about 10°-15° C. After addition, cooling is removed and the solution is stirred for about 15 hours. Then an equal volume of distilled water is added, the organic layer separated and washed again with water. The organic layer is dried with $Mg(SO_4)$ and vacuum distilled to give methyl isobutyl fulvene product as a yellow liquid.

EXAMPLE 2

Preparation of Methyl Vinyl Fulvene

Into a glass reactor equipped with a dropping funnel and nitrogen inlet is charged methanol (240 ml) containing potassium hydroxide (1.2 moles). The solution is cooled to 10°-15° C. and freshly distilled cyclopentadiene (2 moles) is added. The solution is cooled to −5° to 5° C. and methylvinylketone (2 moles) is added dropwise during 2¾ hours. After addition, cooling is removed and the solution is stirred for about 15 hours. Then an equal volume of distilled water is added and the organic layer is extracted with chloroform. The organic layer is separated, dried and the chloroform evaporated leaving a red viscous oil, which is vacuum distilled to give the product, methyl vinyl fulvene.

EXAMPLE 3

Preparation of 2-(4-methyl-4-methoxy)pentylidene Cyclopentadiene

Into a glass reactor equipped with a dropping funnel and nitrogen inlet is charged methanol (240 ml) containing potassium hydroxide (1.2 moles). The solution is cooled to 10°-15° C. when freshly distilled cyclopentadiene (2 moles) is added. From the dropping funnel pentoxone is added dropwise during 1.7 hours. After addition cooling is removed and the solution is stirred for about 15 hours. Then an equal volume of distilled water is added, the organic layer separated and washed again with water. The organic layer is dried and vacuum distilled giving the product, 2-(4-methyl-4-methoxy)pentylidene cyclopentadiene.

EXAMPLE 4

Preparation of Furfuryl Fulvene

Into a glass reactor equipped with a nitrogen inlet is charged methanol (238 ml), freshly distilled cyclopentadiene (2 moles), furfural (2 moles) and diethylamine (8 ml). The resulting reaction is slightly exothermic. The dark red solution is stirred for 7½ hours. At this time an equal volume of distilled water is added and extracted with chloroform. The organic layer is dried and evaporated leaving a dark red viscous oil as the product, furfuryl fulvene.

EXAMPLE 5

Foundry sand mixes are prepared by mixing a cobalt naphthenate catalyst in mineral oil onto the sand. A composition containing a fulvene as shown in Table I below and about 0.25% by weight of vinyl-tris(β-methoxy-ethoxy)silane based on the amount of fulvene is mixed on the sand. The fulvene is employed in an amount of about 1.5 parts by weight per 100 parts of sand. The sand employed is Wedron 5010 silica sand. The cobalt naphthenate in mineral oil contains about 12% cobalt, is available from Mooney Chemical under the trade designation CEM-ALL Drier, and is employed in an amount of about 5% by weight of the fulvene (i.e. about 0.6% of cobalt based on the amount of fulvene). The compositions are shaped into standard AFS tensile test samples and tensile strengths in psi, and work time and strip time are presented below in Table I.

TABLE I

| Fulvene | Work Time/ Strip Time | TENSILE STRENGTH, PSI 1 Hr. | 3 Hr. | 24 Hr. | 24 Hr. + 1 Hr. 100% RH |
|---|---|---|---|---|---|
| Methylphenyl fulvene | 60/90' | 73 | 62 | 58 | 48 |
| Furfuryl fulvene | 95/180' | 97 | 93 | 92 | 83 |
| Methyl isopentyl fulvene | 30/60' | 128 | 118 | 90 | 67 |

EXAMPLE 6

Example 5 is repeated except that a lead naphthenate catalyst is employed in place of the cobalt catalyst. The lead naphthenate catalyst contains 8% and is available from Mooney Chemical under the trade designation Ten Cem Driers. The results obtained are similar to those obtained in Example 5.

EXAMPLE 7

Example 5 is repeated except that a mixture of equal parts of 8% cobalt naphthenate and 8% lead naphthenate catalyst is employed in place of the cobalt catalyst. The results obtained are similar to those obtained in Example 5.

EXAMPLE 8

Example 5 is repeated except that the fulvene composition also includes about 5% by weight of methylethylketone peroxide based upon the fulvene. The results are shown below in Table II.

TABLE II

| Fulvene | Work Time/ Strip Time | TENSILE STRENGTH, PSI 1 Hr. | 3 Hr. | 24 Hr. | 24 Hr. + 1 Hr. 100% RH |
|---|---|---|---|---|---|
| Methyl Isopentyl Fulvene | 15/30' | 108 | 103 | 70 | 40 |
| Methyl Phenyl Fulvene | 7/15' | 70 | 77 | 70 | 23 |
| Methyl Isobutyl Fulvene | 10/25' | 130 | 147 | 113 | 97 |
| Furfuryl Fulvene | 95/210' | 97 | 93 | 92 | 43 |

The addition of the peroxide catalyst in most instances results in decrease in the work time and strip time. It is noted that the use of the peroxide alone does not result in a room temperature curable formulation with the fulvenes.

EXAMPLE 9

Foundry sand mixes are prepared by mixing a cobalt naphthenate catalyst in mineral oil onto the sand. A composition containing a fulvene and an unsaturated material as shown in Table III below, about 0.25% by weight of vinyl-tris(β-methoxyethoxy)silane based on the amount of fulvene and unsaturated material, and about 5% by weight of methylethylketone peroxide based on the amount of fulvene and unsaturated material is mixed onto the sand. The total of the fulvene and unsaturated material is about 2% by weight based upon the sand. The sand employed is Wedron 5010 silica sand. The cobalt naphthenate in mineral oil contains about 12% cobalt and is employed in an amount of about 5% by weight of the fulvene and unsaturated material (i.e. about 0.6% of cobalt based on the amount of fulvene and unsaturated material). The compositions are shaped into standard AFS tensile test samples, and tensile strengths in psi are presented below in Table III.

TABLE III

| | TENSILE STRENGTH, PSI 1 Hr. | 3 Hr. | 24 Hr. | 24 Hr. + 1 Hr. 100% RH |
|---|---|---|---|---|
| Methylphenyl fulvene, 70% - Trimethylolpropane triacrylate, 30% | 137 | 230 | 190 | 120 |
| Methylisopentyl fulvene, 60% - Trimethylolpropane triacrylate, 40% | 40 | 100 | 233 | 130 |
| Methylphenyl fulvene, 70% - Pentaerythritol triacrylate, 30% | 57 | 133 | 240 | 127 |
| Methylisopentyl fulvene, 50% - Polybutadiene resin, 50% | 43 | 95 | 173 | 77 |

As noted from Table III, the presence of the unsaturated materials results in improved strength characteristics as compared to the fulvene alone.

EXAMPLE 10

Foundry sand mixes are prepared by mixing a cobalt naphthenate catalyst in mineral oil onto Wedron 5010 silica sand. A composition containing about 7 parts by weight of methyl β-methoxy-isobutylfulvene per 3 parts by weight of an acrylate as shown in Table IV below, about 0.25% by weight of vinyl-tris (β-methoxyethoxy)silane based upon the total of fulvene and acrylates, and about 5% by weight of methylethylketone peroxide based upon the total of fulvene and acrylate is mixed onto the sand. The total of fulvene and acrylate employed is about 2 parts by weight per 100 parts of sand unless stated otherwise. The cobalt naphthenate in mineral oil contains about 12% by weight cobalt (available under the trade designation CEM-ALL from Mooney Chemical) and is employed in an amount of about 5% by weight based upon the total of fulvene and unsaturated compound. The compositions are shaped into standard AFS tensile test samples, and tensile strengths in psi are presented below in Table IV.

TABLE IV

| UNSATURATED MATERIAL | TENSILE, PSI (SCRATCH HARDNESS) 1 Hr. | 3 Hr. | 24 Hr. | 24 Hr. + 1 Hr. 100% RH |
|---|---|---|---|---|
| Hexanediol diacrylate | 68(79) | 180(90) | 245(93) | 133(85) |
| Diethyleneglycol diacrylate | 112(80) | 185(86) | 210(85) | 88(73) |
| *Trimethylolpropane triacrylate | 129(78) | 157(75) | 160(74) | 65(74) |
| Ethoxylated bisphenol-A diacrylate (available from Sartomer Company under trade designation SR-349) | 87(82) | 200(90) | 257(85) | 97(87) |

*total of fulvene and unsaturated compound is 1.33 parts per 100 parts of sand.

EXAMPLE 11

Foundry sand mixes are prepared by mixing a cobalt naphthenate catalyst in mineral oil onto Wedron 5010 silica sand. A composition containing about 7 parts by weight of methylphenyl fulvene per 3 parts by weight of an acrylate as shown in Table 5 below, about 0.25% by weight of vinyl-tris(β-methoxy-ethoxy)silane based upon the total of fulvene and acrylate, and about 5% by weight of methylethylketone peroxide based upon the total of fulvene and acrylate is mixed onto the sand. The total of fulvene and acrylate employed is about 2 parts by weight per 100 parts of sand. The cobalt naphthenate and mineral oil contains about 12% by weight cobalt (available under the trade designation CEM-ALL from Mooney Chemical) and is employed in an amount of about 5% by weight based upon the total of fulvene and unsaturated compound. The compositions are shaped into standard AFS tensile test samples, and tensile strengths and psi are presented below in Table V.

TABLE V

| | TENSILE, PSI (SCRATCH HARDNESS) 1 Hr. | 3 Hr. | 24 Hr. | 24 Hr. + 1 Hr. 100% RH |
|---|---|---|---|---|
| Hexanediol diacrylate | 120(85) | 135(86) | 123(86) | 63(86) |
| Diethyleneglycol diacrylate | 125(86) | 123(81) | 130(84) | 73(81) |
| Trimethylolpropane triacrylate | 103(90) | 127(82) | 130(77) | 70(75) |
| Pentaerythritol triacrylate | 123(91) | 177(90) | 159(89) | 73(87) |
| Ethoxylated bisphenol-A diacrylate | 70(81) | 130(91) | 163(85) | 97(86) |

EXAMPLE 12

Foundry sand mixes are prepared by mixing a cobalt naphthenate catalyst in mineral oil onto Wedron 5010 silica sand. A composition containing about 7 parts by weight of cyclohexamethylene fulvene per 3 parts by weight of an acrylate as shown in Table VI below, about 0.25% by weight of vinyl-tris(β-methoxy-ethoxy)silane based upon the total of fulvene acrylate, and about 5% by weight of methylethylketone peroxide based upon the total of fulvene and acrylate is mixed onto the sand. The total of fulvene and acrylate employed is about 2 parts by weight per 100 parts of sand. The cobalt naphthenate in mineral oil contains about 12% by weight cobalt (available under the trade designation CEM-ALL from Mooney Chemical) and is employed in an amount of about 5% by weight based upon the total of fulvene and unsaturated compound. The compositions are shaped into standard AFS tensile tests samples, and tensile strengths in psi are presented below in Table VI.

TABLE VI

| | TENSILE, PSI (SCRATCH HARDNESS) 1 Hr. | 3 Hr. | 24 Hr. | 24 Hr. + 1 Hr. 100% RH |
|---|---|---|---|---|
| Hexanediol diacrylate | 153(88) | 143(89) | 185(88) | 30(87) |
| Diethyleneglycol diacrylate | 145(89) | 137(84) | 157(89) | 03(84) |
| Trimethylolpropane triacrylate | 115(87) | 135(84) | 123(80) | 2(80) |
| Pentaerythritol triacrylate | 163(90) | 210(91) | 237(89) | 20(85) |
| Ethoxylated bisphenol-A diacrylate | 70(88) | 143(93) | 223(89) | 28(91) |

EXAMPLE 13

Foundry sand mixes are prepared by mixing a cobalt naphthenate catalyst in mineral oil onto Wedron 5010 silica sand. A composition containing about 7 parts by weight of methylisopentyl fulvene per 3 parts by weight of trimethylolpropane triacrylate, about 0.25 parts by weight of vinyl-tris(β-methoxy-ethoxy)silane based upon the total of fulvene and acrylate, and methylethylketone peroxide is mixed onto the sand. The total of fulvene and acrylate employed is about 2 parts by weight per 100 parts of sand. The cobalt naphthenate in mineral oil contains about 12% by weight cobalt available under the trade designation CHEM-ALL from Mooney Chemical. The amount of cobalt naphthenate employed and the amount of peroxide are shown in Table VII below. The compositions are shaped into standard AFS tensile test samples, and tensile strengths in psi are presented below in Table VII.

TABLE VII

| CATALYST LEVEL, % | | TENSILE, PSI (SCRATCH HARDNESS) | | | |
|---|---|---|---|---|---|
| COBALT | PEROXIDE | 1 Hr. | 3 Hr. | 24 Hr. | 24 Hr. + 1 Hr. 100% RH |
| 5 | 5 | 227(97) | 247(93) | 190(88) | 105(86) |
| 5 | 10 | 70(84) | 175(86) | 170(86) | 113(80) |
| 2 | 5 | 70(90) | 193(95) | 177(94) | 140(88) |
| 10 | 5 | 100(93) | 173(90) | 177(91) | 113(90) |

EXAMPLE 14

Foundry sand mixes are prepared by mixing a cobalt naphthenate catalyst in mineral oil onto Wedron 5010 silica sand. A composition containing about 7 parts by weight of methylisopentyl fulvene per 3 parts by weight of trimethylolpropane triacrylate, about 0.2 parts by weight of vinyl-tris(β-methoxyethoxy)silane based upon the total of fulvene and acrylate, and about 5% by weight of methylethylketone peroxide based upon the total of fulvene and acrylate is mixed onto the sand. The total of fulvene and acrylate employed is about 2 parts by weight per 100 parts of sand. The cobalt naphthenate and mineral oil contains about 12% by weight cobalt and is employed in an amount of about 5% by weight based upon the total of fulvene and unsaturated compound. The compositions are shaped into standard AFS tensile test samples, and tensile strengths and psi are presented below in Table VIII after various post curing treatments as shown in Table VIII.

TABLE VIII

| POST HEAT TREATMENT | DURATION OF CURE | TENSILES PSI |
|---|---|---|
| 28 (control)°C. | 24 hr. | 190 |
| 50° C. | overnight | 240 |
| 100° C. | 0.5 hr. | 237 |
| 150° C. | 0.5 hr. | 297 |
| 200° C. | 0.5 hr. | 370 |

EXAMPLE 15

A step cone is prepared by hand ramming a mold with Wedron 5010 silica sand mixed with a cobalt naphthenate catalyst in mineral oil and a composition containing about 7 parts by weight of methylisobutyl fulvene per 3 parts by weight of ethoxylated biphenol-A diacrylate, about 0.25% by weight of vinyl-tris(β-methoxyethoxy)silane based upon the total of fulvene and acrylate, and about 5% by weight of methylethylketone peroxide based upon the total of fulvene and acrylate. The total of fulvene and acrylate employed is about 2 parts by weight per 100 parts of sand. The cobalt naphthenate and mineral oil contains about 12% by weight cobalt and is employed in an amount of about 5% by weight based upon the total of fulvene and unsaturated compound.

After curing, the core is stripped and placed in the step cone mold. A casting is poured in gray iron. The casting weighed about 28 pounds. The casting showed some veining, no gas defects, no erosion and a good surface appearance.

What is claimed is:

1. A process for casting a metal which comprises:

(a) pouring metal while in the liquid state into or around a molded article obtained by:

(1) introducing a molding composition into a mold wherein said molding composition comprises a major amount of aggregate and an effective bonding amount up to about 40% by weight of the aggregate of a composition capable of curing in the presence of oxygen containing a fulvene of the formula:

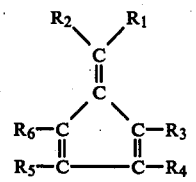

wherein each $R_1$ and $R_2$, individually, is hydrogen or a hydrocarbon containing 1 to 10 carbon atoms, or a hydrocarbon containing 1 or more oxygen bridges in the chain; or a furyl group; or are interconnected to form a cyclic group; each $R_3$ and $R_6$, individually, is hydrogen or methyl; each $R_4$ and $R_5$ is hydrogen or methyl or

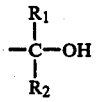

provided that a maximum of only one such $R_3$, $R_4$, $R_5$, and $R_6$ is methyl and provided that a maximum of any one such $R_4$ and $R_5$ is

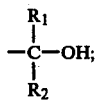

or prepolymer thereof or mixtures thereof; and a catalytic amount of a metal salt of a carboxylic acid catalyst wherein the metal constituent of said salt is capable of existing in at least two valence states;

(2) hardening the composition in the mold to become self-supporting; and (3) thereafter removing the shaped article of step (2) from the mold and allowing it to further cure, thereby obtaining a hardened, solid, cured, molded article;

(b) allowing the metal to cool and solidify, and (c) separating the molded metal article.

2. The process of claim 1 wherein said metal is iron.

3. The process of claim 1 wherein the composition is hardened in the presence of air at normal room temperatures.

4. The process of claim 1 wherein the amount of bonding agent is up to about 10% by weight based upon the weight of the aggregate.

5. The process of claim 4 wherein said aggregate is sand.

6. The process of claim 4 wherein said foundry composition contains about 0.5 to about 7% by weight of the aggregate of said composition capable of curing in the presence of oxygen.

7. The process of claim 1 wherein said fulvene is selected from the group of dimethyl fulvene, methylisobutyl fulvene, methylisopentyl fulvene, methylphenyl fulvene, cyclohexyl fulvene, methylethyl fulvene, diphenyl fulvene, furyl fulvene, diisobutyl fulvene, isophorone fulvene, methylvinyl fulvene, methyl β-methoxyisobutyl fulvene, and mixtures thereof.

8. The process of claim 1 wherein the metal constituent of said metal salt is selected from the group of Group IB metals, Group IVA metals, Group IVB metals, Group III, Group VB metals, Group VII metals, and Group VIII metals.

9. The process of claim 1 wherein said metal constituent of said salt is selected from the group of cobalt, lead, vanadium, and mixtures thereof.

10. The process of claim 1 wherein said metal salt catalyst is a cobalt catalyst.

11. The process of claim 1 wherein said catalyst is cobalt naphthenate.

12. The process of claim 1 wherein said catalyst is lead naphthenate.

13. The process of claim 1 wherein said metal salt catalyst is present in an amount of about 0.2 to about 1.2% by weight of metal based upon the weight of fulvene in the composition.

14. The process of claim 1 wherein the composition further includes an ethylenically unsaturated polymerizable material and a material selected from the group of peroxide, hydroperoxide, or mixtures thereof.

15. The process of claim 14 wherein said ethylenically unsaturated material is a polyethylenically unsaturated material.

16. The process of claim 15 wherein said unsaturated material is an ester of an acrylate or methacrylate, or mixture thereof.

17. The process of claim 15 wherein said unsaturated compound is selected from the group of polyethyleneglycol diacrylate, trimethylolpropane triacrylate, hexanediol diacrylate, trimethylolpropane triacrylate, hexanediol diacrylate, and ethoxylated bisphenol-A diacrylate, and mixtures thereof.

18. The process of claim 14 wherein the amount of said ethylenically unsaturated polymerizable material is up to about 50% by weight based upon the weight of the fulvene and ethylenically unsaturated compound.

19. The process of claim 14 wherein the amount of said ethylenically unsaturated polymerizable material is about 20 to about 40% by weight based upon the weight of the fulvene and ethylenically unsaturated compound.

20. The process of claim 14 wherein the peroxide or hydroperoxide, or mixture thereof, is present in an amount of about 1 to about 15% by weight based upon the weight of the fulvene and ethylenically unsaturated material.

21. The process of claim 14 wherein said peroxide or hydroperoxide, or mixture thereof, is present in an amount of about 3 to about 8% by weight based upon the weight of the fulvene and ethylenically unsaturated material.

22. The process of claim 14 wherein said peroxide is methylethyl ketone peroxide.

* * * * *